US011510018B2

(12) United States Patent
Serman et al.

(10) Patent No.: US 11,510,018 B2
(45) Date of Patent: Nov. 22, 2022

(54) HEARING SYSTEM CONTAINING A HEARING INSTRUMENT AND A METHOD FOR OPERATING THE HEARING INSTRUMENT

(71) Applicant: Sivantos Pte. Ltd., Singapore (SG)

(72) Inventors: Maja Serman, Erlangen (DE); Cecil Wilson, Erlangen (DE); Eghart Fischer, Schwabach (DE)

(73) Assignee: Sivantos Pte. Ltd., Singapore (SG)

( * ) Notice: Subject to any disclaimer, the term of this patent is extended or adjusted under 35 U.S.C. 154(b) by 190 days.

(21) Appl. No.: 17/098,611

(22) Filed: Nov. 16, 2020

(65) Prior Publication Data

US 2021/0152949 A1 May 20, 2021

(30) Foreign Application Priority Data

Nov. 15, 2019 (EP) ..... 19209360

(51) Int. Cl.
*H04R 25/00* (2006.01)
*G10L 21/0364* (2013.01)
*G10L 25/78* (2013.01)

(52) U.S. Cl.
CPC ..... *H04R 25/505* (2013.01); *G10L 21/0364* (2013.01); *G10L 25/78* (2013.01);
(Continued)

(58) Field of Classification Search
CPC ..... H04R 25/505; H04R 25/604; H04R 2225/021; H04R 2225/025; H04R 2225/43; H04R 25/356; H04R 25/50
See application file for complete search history.

(56) References Cited

U.S. PATENT DOCUMENTS 6,768,801 B1 7/2004 Wagner et al.
7,454,345 B2 11/2008 Sasaki et al.
(Continued)

FOREIGN PATENT DOCUMENTS

CN 103262577 A 8/2013
CN 103686571 A 3/2014
(Continued)

OTHER PUBLICATIONS

Vaseghi S et al: "Speech Accent Profiles: Modeling and Synthesis (Applications Corner)". IEEE Signal Processing Magazine. IEEE Service Center Piscataway NJ US. vol. 26. No. 3. May 1, 2009 (May 1, 2009), pp. 69-74, XP011268352, ISSN: 1053-5888. DOI: 10.1109/MSP.2009.932161, p. 4; figure 4; table 1.

*Primary Examiner* — Brian Ensey
(74) *Attorney, Agent, or Firm* — Laurence A. Greenberg; Werner H. Stemer; Ralph E. Locher

(57) ABSTRACT

A hearing system contains a hearing instrument and the hearing instrument is configured to support the hearing of a hearing-impaired user. The hearing instrument is operated via an operating method. The method includes capturing a sound signal from an environment of the hearing instrument, processing the captured sound signal to at least partially compensate the hearing-impairment of the user and outputting the processed sound signal to the user. The captured sound signal is analyzed to recognize speech intervals, in which the captured sound signal contains speech. During recognized speech intervals, at least one time derivative of an amplitude and/or a pitch of the captured sound signal is determined. The amplitude of the processed sound signal is temporarily increased, if the at least one derivative fulfills a predefined criterion.

20 Claims, 5 Drawing Sheets

(52) U.S. Cl.
CPC ..... *H04R 25/604* (2013.01); *H04R 2225/021* (2013.01); *H04R 2225/025* (2013.01); *H04R 2225/43* (2013.01)

(56) References Cited

U.S. PATENT DOCUMENTS

| | | | | |
|---|---|---|---|---|
| 8,139,787 | B2 * | 3/2012 | Haykin | G10L 21/02 381/94.1 |
| 9,064,501 | B2 * | 6/2015 | Yamada | G10L 25/48 |
| 9,191,753 | B2 | 11/2015 | Meincke et al. | |
| 9,374,646 | B2 | 6/2016 | Li | |
| 9,538,296 | B2 | 1/2017 | Rasmussen et al. | |
| 9,769,576 | B2 | 9/2017 | Marquis et al. | |
| 10,403,306 | B2 * | 9/2019 | Kamkar Parsi | H04R 25/305 |
| 2003/0004723 | A1 | 1/2003 | Chihara | |
| 2011/0196678 | A1 | 8/2011 | Hanazawa | |
| 2013/0148829 | A1 | 6/2013 | Lugger | |
| 2013/0211832 | A1 | 8/2013 | Talwar et al. | |
| 2013/0211839 | A1 | 8/2013 | Kato | |
| 2016/0183014 | A1 | 6/2016 | Guo et al. | |
| 2017/0311091 | A1 | 10/2017 | Nakagawa et al. | |
| 2018/0176696 | A1 | 6/2018 | Voigt Pedersen | |
| 2018/0277132 | A1 * | 9/2018 | LeVoit | G10L 25/57 |

FOREIGN PATENT DOCUMENTS

| | | | |
|---|---|---|---|
| CN | 104469643 | A | 3/2015 |
| CN | 105122843 | A | 12/2015 |
| CN | 105721983 | A | 6/2016 |
| CN | 108206978 | A | 6/2018 |
| EP | 1101390 | B1 | 4/2004 |
| WO | 2004066271 | A1 | 8/2004 |
| WO | 2016078786 | A1 | 5/2016 |
| WO | 2017143333 | A1 | 8/2017 |

* cited by examiner

HEARING SYSTEM CONTAINING A HEARING INSTRUMENT AND A METHOD FOR OPERATING THE HEARING INSTRUMENT

CROSS-REFERENCE TO RELATED APPLICATION

This application claims the priority, under 35 U.S.C. § 119, of European application EP 19 209 360, filed Nov. 15, 2019; the prior application is herewith incorporated by reference in its entirety.

BACKGROUND OF THE INVENTION

Field of the Invention

The invention relates to a method for operating a hearing instrument. The invention further relates to a hearing system containing a hearing instrument.

Generally, a hearing instrument is an electronic device being configured to support the hearing of a person wearing it (which person is called the user or wearer of the hearing instrument). In particular, the invention relates to hearing instruments that are specifically configured to at least partially compensate a hearing impairment of a hearing-impaired user.

Hearing instruments are most often designed to be worn in or at the ear of the user, e.g. as a Behind-The-Ear (BTE) or In-The-Ear (ITE) device. Such devices are called "hearings aids". With respect to its internal structure, a hearing instrument normally contains an (acousto-electrical) input transducer, a signal processor and an output transducer. During operation of the hearing instrument, the input transducer captures a sound signal from an environment of the hearing instrument and converts it into an input audio signal (i.e. an electrical signal transporting a sound information). In the signal processor, the input audio signal is processed, in particular amplified dependent on frequency, to compensate the hearing-impairment of the user. The signal processor outputs the processed signal (also called output audio signal) to the output transducer. Most often, the output transducer is an electro-acoustic transducer (also called "receiver") that converts the output audio signal into a processed air-borne sound which is emitted into the ear canal of the user. Alternatively, the output transducer may be an electromechanical transducer that converts the output audio signal into a structure-borne sound (vibrations) that is transmitted, e.g., to the cranial bone of the user. Furthermore, besides classical hearing aids, there are implanted hearing instruments such as cochlear implants, and hearing instruments the output transducers of which directly stimulate the auditory nerve of the user.

The term "hearing system" denotes one device or an assembly of devices and/or other structures providing functions required for the operation of a hearing instrument. A hearing system may consist of a single stand-alone hearing instrument. As an alternative, a hearing system may comprise a hearing instrument and at least one further electronic device which may, e.g., be one of another hearing instrument for the other ear of the user, a remote control and a programming tool for the hearing instrument. Moreover, modern hearing systems often comprise a hearing instrument and a software application for controlling and/or programming the hearing instrument, which software application is or can be installed on a computer or a mobile communication device such as a mobile phone (smart phone). In the latter case, typically, the computer or the mobile communication device are not a part of the hearing system. In particular, most often, the computer or the mobile communication device will be manufactured and sold independently of the hearing system.

A typical problem of hearing-impaired persons is bad speech perception which is often caused by the pathology of the inner ear resulting in an individual reduction of the dynamic range of the hearing-impaired person. This means that soft sounds become inaudible to the hearing-impaired listener (particularly in noisy environments) whereas loud sounds retain their loudness levels.

Hearing instruments commonly compensate hearing loss by amplifying the input signal. Hereby, a reduced dynamic range of the hearing-impaired user is often compensated using compression, i.e. the amplitude of the input signal is increased as a function of the input signal level. However, commonly used implementations of compression in hearing instruments often result in various technical problems and distortions due to the real time constraints of the signal processing. Moreover, in many cases, compression is not sufficient to enhance speech perception to a satisfactory extent.

A hearing instrument including a specific speech enhancement algorithm is known from European patent EP 1 101 390 B1, corresponding to U.S. Pat. No. 6,768,801. Here, the level of speech segments in an audio stream is increased. Speech segments are recognized by analyzing the envelope of the signal level. In particular, sudden level peaks (bursts) are detected as an indication of speech.

BRIEF SUMMARY OF THE INVENTION

An object of the present invention is to provide a method for operating a hearing instrument being worn in or at the ear of a user which method provides improved speech perception to the user wearing the hearing instrument.

Another object of the present invention is to provide a hearing system containing a hearing instrument to be worn in or at the ear of a user which system provides improved speech perception to the user wearing the hearing instrument.

According to a first aspect of the invention, a method for operating a hearing instrument that is configured to support the hearing of a hearing-impaired user is provided. The method contains capturing a sound signal from an environment of the hearing instrument, e.g. by an input transducer of the hearing instrument. The captured sound signal is processed, e.g. by a signal processor of the hearing instrument, to at least partially compensate the hearing-impairment of the user, thus producing a processed sound signal. The processed sound signal is output to the user, e.g. by an output transducer of the hearing instrument. In preferred embodiments, the captured sound signal and the processed sound signal, before being output to the user, are audio signals, i.e. electric signals transporting a sound information.

The hearing instrument may be of any type as specified above. Preferably, it is configured to worn in or at the ear of the user, e.g. as a BTE hearing aid (with internal or external receiver) or as an ITE hearing aid. Alternatively, the hearing instrument may be configured as an implantable hearing instrument. The processed sound signal may be output as air-borne sound, as structure-borne sound or as a signal directly stimulating the auditory nerve of the user.

The method further contains:

a) a speech recognition step in which the captured sound signal is analyzed to recognize speech intervals, in which the captured sound signal contains speech;

b) a derivation step in which, during recognized speech intervals, at least one derivative of an amplitude and/or a pitch, i.e. a fundamental frequency, of the captured sound signal is determined; here and hereafter, unless indicated otherwise, the term "derivative" always denotes a "time derivative" in the mathematical sense of this term; and c) a speech enhancing step in which the amplitude of the processed sound signal is temporarily increased (i.e. an additional gain is temporarily applied), if the at least one derivative fulfills a predefined criterion.

The invention is based on the finding that speech sound typically involves a rhythmic (i.e. more or less periodic) series of variations, in particular peaks, of short duration which, in the following, will be denoted "(speech) accents". In particular, such speech accents may show up as variations of the amplitude and/or the pitch of the speech sound, and have turned out to be essential for speech perception. The invention aims to recognize and enhance speech accents to provide a better speech perception. It was found that speech accents are very effectively recognized by analyzing derivatives of the amplitude and/or the pitch of the captured sound signal.

In the speech enhancing step, the at least one derivative is compared with the predefined criterion, and a speech accent is recognized if said criterion is fulfilled by the at least one derivative. By temporarily applying a gain and, thus, temporarily increasing the amplitude of the processed sound signal, recognized speech accents are enhanced and are, thus, more easily perceived by the user.

Preferably, in the speech enhancing step, the amplitude of the processed sound signal is increased for a predefined time interval (which means that the additional gain and, thus, the increase of the amplitude, is reduced to the end of the enhancement interval). In suited embodiments, the time interval (which, in the following, will be denoted the "enhancement interval") is set to a value between 5 to 15 msec, in particular 10 msec.

In an embodiment of the invention, the amplitude of the processed sound signal may be abruptly (step-wise) increased, if the at least one derivative fulfills the predefined criterion, and abruptly (step-wise) decreased at the end of the enhancement interval. However, preferably, the amplitude of the processed sound signal is continuously increased and/or continuously decreased within said predefined time interval, in order to avoid abrupt level variations in the processed sound signal. In particular, the amplitude of the processed sound signal is increased and/or decreased according to a smooth function of time.

In a further embodiment of the invention, the at least one derivative contains a first (order) derivative. Here, the terms "first derivative" or "first order derivative" are used according to their mathematical meaning denoting a measure indicative of the change of the amplitude or the pitch of the captured sound signal over time. Preferably, in order to reduce the risk of falsely detecting speech accents, the at least one derivative is a time-averaged derivative of the amplitude and/or the pitch of the captured sound signal. The time-averaged derivative may be either determined by averaging after derivation or by derivation after averaging. In the former case the time-averaged derivative is derived by averaging a derivative of non-averaged values of the amplitude or the pitch. In the latter case, the derivative is derived from time-averaged values of the amplitude or the pitch. Preferably, the time constant of such averaging (i.e. the time window of a moving average) is set to a value between 5 and 25 msec, in particular 10 to 20 msec.

In a suited embodiment of the invention, the predefined criterion involves a threshold. In this case, the occurrence of the speech accent in the captured sound signal is recognized (and the amplitude of the processed sound signal is temporarily increased) if the at least one derivative exceeds said threshold. In a more refined alternative, the predefined criterion involves a range (being defined by a lower threshold and an upper threshold). In this case, the amplitude of the processed sound signal is temporarily increased only if the at least one derivative is within the range (and, thus exceeds the lower threshold but is still below the upper threshold). The latter alternative reflects the idea that strong accents in which derivatives of the amplitude and/or the pitch of the captured sound signals would exceed the upper threshold do not need to be enhanced as these accents are perceived anyway. Instead, only small and medium accents that are likely to be overheard by the user are enhanced.

In simple but effective embodiments of the invention, only one of the amplitude and the pitch of the captured sound signal is analyzed and evaluated to recognize speech accents. In more refined embodiments of the invention, derivatives of both the amplitude and the pitch are determined and evaluated to recognize speech accents. In the latter case, a speech accent is only enhanced if it is recognized from a combined analysis of the temporal changes of amplitude and pitch. For example, a speech accent is only recognized if the derivatives of both the amplitude and the pitch coincidently fulfill the predefined criterion, e.g. exceed respective thresholds or are within respective ranges.

Preferably, the at least one derivative contains a first derivative and at least one higher order derivative (i.e. a derivative of a derivative, e.g. a second or third derivative) of the amplitude and/or the pitch of the captured sound signal. In this case, the predefined criterion relates to both the first derivative and the higher order derivative. For example, in a preferred embodiment, a speech accent is recognized (and the amplitude of the processed sound signal is temporarily increased), if the first derivative exceeds a predefined threshold or is within a predefined range, which threshold or range is varied in dependence of said higher order derivative. As an alternative, a mathematical combination of the first derivative and the higher order derivative is compared with a threshold or range. E.g., the first derivative is weighted with a weighting factor that depends on the higher order derivative, and the weighted first derivative is compared with a pre-defined threshold or range.

In more refined embodiments of the invention, the amplitude of the processed sound signal is temporarily increased by an amount that is varied in dependence of the at least one derivative. In addition or as an alternative, the enhancement interval may be varied in dependence of the at least one derivative. Thus, small and strong accents are enhanced to varying degrees.

By preference, in the speech recognition step, recognized speech intervals are distinguished into own-voice intervals, in which the user speaks, and foreign-voice intervals, in which at least one different speaker speaks. In this case, in the normal operation of the hearing instrument, the speech enhancement step and, optionally, the derivation step are only performed during foreign-voice intervals. In other words, speech accents are not enhanced during own-voice intervals. This embodiment reflects the experience that enhancement of speech accents is not needed when the user speaks as the user—knowing what he or she has said—has no problem to perceive his or her own voice. By stopping enhancement of speech accents during own-voice intervals, a processed sound signal containing a more natural sound of the own voice is provided to the user.

According to a second aspect of the invention, a hearing system with a hearing instrument (as previously specified) is provided. The hearing instrument contains an input transducer arranged to capture an (original) sound signal from an environment of the hearing instrument, a signal processor arranged to process the captured sound signal to at least partially compensate the hearing-impairment of the user (thus providing a processed sound signal), and an output transducer arranged to emit the processed sound signal to the user. In particular, the input transducer converts the original sound signal into an input audio signal (containing information on the captured sound signal) that is fed to the signal processor, and the signal processor outputs an output audio signal (containing information on the processed sound signal) to the output transducer which converts the output audio signal into air-borne sound, structure-borne sound or into a signal directly stimulating the auditory nerve.

Generally, the hearing system is configured to automatically perform the method according to the first aspect of the invention. To this end, the system contains:

a) a voice recognition unit that is configured to analyze the captured sound signal to recognize speech intervals, in which the captured sound signal contains speech;

b) a derivation unit configured to determine, during recognized speech intervals, at least one (time) derivative of an amplitude and/or a pitch of the captured sound signal; and c) a speech enhancement unit configured to temporarily increase the amplitude of the processed sound signal, if the at least one derivative fulfills a predefined criterion.

For each embodiment or variant of the method according to the first aspect of the invention there is a corresponding embodiment or variant of the hearing system according to the second aspect of the invention. Thus, disclosure related to the method also applies, mutatis mutandis, to the hearing system, and vice-versa.

In particular, in preferred embodiments of the hearing system:

a) the speech enhancement unit may be configured to increase the amplitude of the processed sound signal for a predefined enhancement interval of, e.g., 5 to 15 msec, in particular ca. 10 msec, if the at least one derivative fulfills the predefined criterion, b) the speech enhancement unit may be configured to continuously increase and/or decrease the amplitude of the processed sound signal within the predefined time interval, c) the speech enhancement unit may be configured to temporarily increase the amplitude of the processed sound signal, according to the predefined criterion, if the at least one derivative exceeds a predefined threshold or is within a predefined range, d) the speech enhancement unit may be configured to temporarily increase the amplitude of the processed sound signal, according to the predefined criterion, if a first derivative exceeds a predefined threshold or is within a predefined range, and to vary the threshold or range in dependence of a higher order derivative, e) the speech enhancement unit may be configured to temporarily increase the amplitude of the processed sound signal by an amount that is varied in dependence of the at least one derivative, and/or f) the voice recognition unit may be configured to distinguish recognized speech intervals into own-voice intervals and foreign-voice intervals, as defined above, wherein the speech enhancement unit temporarily increases the amplitude of the processed sound signal during foreign-voice intervals only (i.e. not during own-voice intervals).

Preferably, the signal processor is configured as a digital electronic device. It may be a single unit or consist of a plurality of sub-processors. The signal processor or at least one of the sub-processors may be a programmable device (e.g. a microcontroller). In this case, the functionality mentioned above or part of the functionality may be implemented as software (in particular firmware). Also, the signal processor or at least one of the sub-processors may be a non-programmable device (e.g. an ASIC). In this case, the functionality mentioned above or part of the functionality may be implemented as hardware circuitry.

In a preferred embodiment of the invention, the voice recognition unit, the derivation unit and/or the speech enhancement unit are arranged in the hearing instrument. In particular, each of these units may be designed as a hardware or software component of the signal processor or as separate electronic component. However, in other embodiments of the invention, the voice recognition unit, the derivation unit and/or the speech enhancement unit or at least a functional part thereof may be located on an external electronic device such as a mobile phone.

In a preferred embodiment, the voice recognition unit contains a voice activity detection (VAD) module for general voice activity detection and an own voice detection (OVD) module for detection of the user's own voice.

Other features which are considered as characteristic for the invention are set forth in the appended claims.

Although the invention is illustrated and described herein as embodied in a hearing system containing a hearing instrument and a method for operating the hearing instrument, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
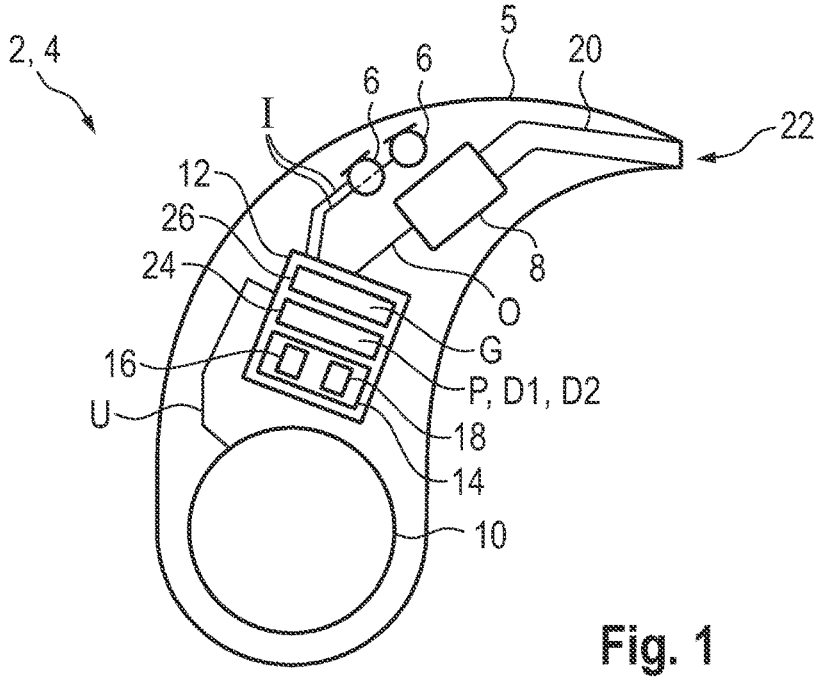
FIG. 1 is a schematic representation of a hearing system containing a hearing aid (i.e. a hearing instrument to be worn in or at the ear of a user), the hearing aid containing an input transducer arranged to capture a sound signal from an environment of the hearing aid, a signal processor arranged to process the captured sound signal, and an output transducer arranged to emit the processed sound signal to the user.

Like reference numerals indicate like parts, structures and elements unless otherwise indicated.

Referring now to the figures of the drawings in detail and first, particularly to FIG. 1 thereof, there is shown a hearing system 2 containing a hearing aid 4, i.e. a hearing instrument being configured to support the hearing of a hearing-impaired user that is configured to be worn in or at one of the ears of the user. As shown in FIG. 1, by way of example, the hearing aid 4 may be configured as a Behind-The-Ear (BTE) hearing aid. Optionally, the system 2 contains a second hearing aid (not shown) to be worn in or at the other ear of the user to provide binaural support to the user.

The hearing aid 4 contains, inside a housing 5, two microphones 6 as input transducers and a receiver 8 as output transducer. The hearing aid 4 further contains a battery 10 and a signal processor 12. Preferably, the signal processor 12 contains both a programmable sub-unit (such as a microprocessor) and a non-programmable sub-unit (such as an ASIC). The signal processor 12 includes a voice recognition unit 14, that contains a voice activity detection (VAD) module 16 and an own voice detection (OVD) module 18. By preference, both modules 16 and 18 are configured as software components being installed in the signal processor 12.

The signal processor 12 is powered by the battery 10, i.e. the battery 10 provides an electrical supply voltage U to the signal processor 12.

During normal operation of the hearing aid 4, the microphones 6 capture a sound signal from an environment of the hearing aid 2. The microphones 6 convert the sound into an input audio signal I containing information on the captured sound. The input audio signal I is fed to the signal processor 12. The signal processor 12 processes the input audio signal I, i.e., to provide a directed sound information (beamforming), to perform noise reduction and dynamic compression, and to individually amplify different spectral portions of the input audio signal I based on audiogram data of the user to compensate for the user-specific hearing loss. The signal processor 12 emits an output audio signal O containing information on the processed sound to the receiver 8. The receiver 8 converts the output audio signal O into processed air-borne sound that is emitted into the ear canal of the user, via a sound channel 20 connecting the receiver 8 to a tip 22 of the housing 5 and a flexible sound tube (not shown) connecting the tip 22 to an ear piece inserted in the ear canal of the user.

The VAD module 16 generally detects the presence of voice (independent of a specific speaker) in the input audio signal I, whereas the OVD module 18 specifically detects the presence of the user's own voice. By preference, modules 16 and 18 apply technologies of VAD and OVD, that are as such known in the art, e.g. from U.S. patent publication 2013/0148829 A1 or international patent disclosure WO 2016/078786 A1. By analyzing the input audio signal I (and, thus, the captured sound signal), the VAD module 16 and the OVD module 18 recognize speech intervals, in which the input audio signal I contains speech, which speech intervals are distinguished (subdivided) into own-voice intervals, in which the user speaks, and foreign-voice intervals, in which at least one different speaker speaks.

Furthermore, the hearing system 2 contains a derivation unit 24 and a speech enhancement unit 26. The derivation unit 24 is configured to derive a pitch P (i.e. the fundamental frequency) of the captured sound signal from the input audio signal I as a time-dependent variable. The derivation unit 24 is further configured to apply a moving average to the measured values of the pitch P, e.g. applying a time constant (i.e. size of the time window used for averaging) of 15 msec, and to derive the first (time) derivative D1 and the second (time) derivative D2 of the time-averaged values of the pitch P.

For example, in a simple yet effective implementation, a periodic time series of time-averaged values of the pitch P is given by . . . , AP[n−2], AP[n−1], AP[n], . . . , where AP[n] is a current value, and AP[n−2] and AP[n−1] are previously determined values. Then, a current value D1[$n$] and a previous value D1[$n-1$] of the first derivative D1 may be determined as $$D1[n]=AP[n]-AP[n-1]=D1, \quad \text{a)}$$

$$D1[n-1]=AP[n-1]-AP[n-2], \quad \text{b)}$$

and a current value D2[$n$] of the second derivative D2 may be determined as $$D2[n]=D1[n]-D1[n-1]=D2. \quad \text{c)}$$

The speech enhancement unit 26 is configured to analyze the derivatives D1 and D2 with respect of a criterion subsequently described in more detail in order to recognize speech accents in input audio signal I (and, thus, the captured sound signal). Furthermore, the speech enhancement unit 26 is configured to temporarily apply an additional gain G and, thus, increase the amplitude of the processed sound signal O, if the derivatives D1 and D2 fulfill the criterion (being indicative of a speech accent).

By preference, both the derivation unit 24 and a speech enhancement unit 26 are configured as software components being installed in the signal processor 12.

Figure 2:
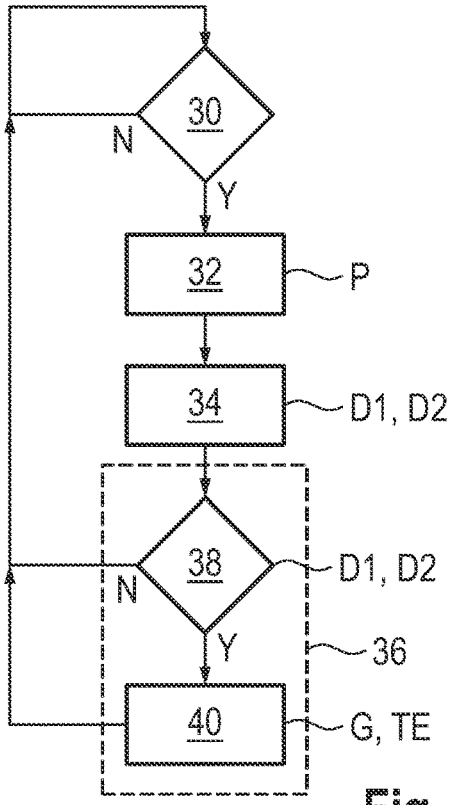
FIG. 2 is a flow chart of a method for operating the hearing aid of FIG. 1, the method containing, in a speech enhancement step, temporarily applying a gain and, thus, temporarily increasing the amplitude of the processed sound signal to enhance speech accents of a foreign-voice speech in the captured sound signal.

During normal operation of the hearing aid 4, the voice recognition unit 14, i.e. the VAD module 16 and the OVD module 18, the derivation unit 24 and the speech enhancement unit 26 interact to execute a method illustrated in FIG. 2.

In a first step 30 of the method, the voice recognition unit 14 analyzes the input audio signal I for foreign voice intervals, i.e. it checks whether the VAD module 16 returns a positive result (indicative of the detection of speech in the input audio signal I), while the OVD module 18 returns a negative result (indicative of the absence of the own voice of the user in the input audio signal I).

If a foreign voice interval is recognized (Y), the voice recognition unit 14 triggers the derivation unit 24 to execute a next step 32. Otherwise (N), step 30 is repeated.

In step 32, the derivation unit 24 derives the pitch P of the captured sound from the input audio signal I and applies time averaging to the pitch P as described above. In a subsequent step 34, the derivation unit 24 derives the first derivative D1 and the second derivative D2 of the time-averaged values of the pitch P. Thereafter, the derivation unit 24 triggers the speech enhancement unit 26 to perform a speech enhancement step 36 which, in the example shown in FIG. 2, is subdivided into two steps 38 and 40.

In the step 38, the speech enhancement unit 26 analyzes the derivatives D1 and D2 as mentioned above to recognize speech accents. If a speech accent is recognized (Y) the speech enhancement unit 26 proceeds to step 40. Otherwise (N), i.e. if no speech accent is recognized, the speech enhancement unit 26 triggers the voice recognition unit 14 to execute step 30 again.

In step 40, the speech enhancement unit 26 temporarily applies the additional gain G to the processed sound signal. Thus, for a predefined time interval (called enhancement interval TE), the amplitude of the processed sound signal O is increased, thus enhancing the recognized speech accent. After expiration of enhancement interval TE, the gain G is reduced to 1 (0 dB). Subsequently, the speech enhancement unit 26 triggers the voice recognition unit 14 to execute step 30 and, thus, the method of FIG. 2 again.

Figure 3:
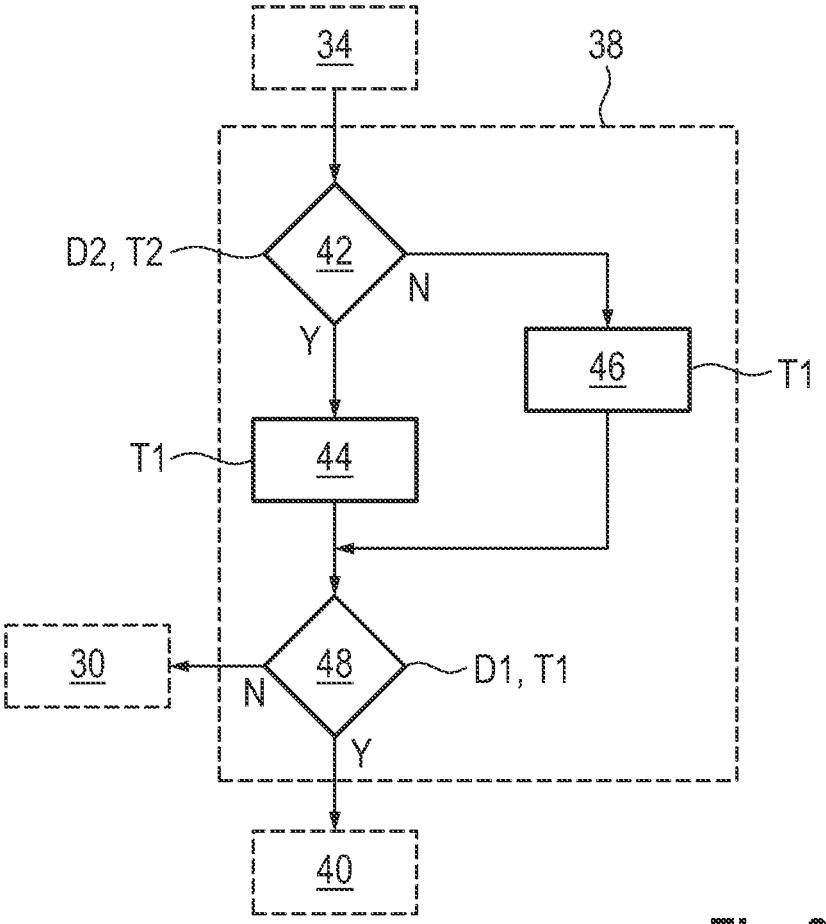
FIG. 3 is a flow chart of a first embodiment of a method step for recognizing speech accents, which method step is a part of the speech enhancement step of the method according to FIG. 2.
Figure 4:
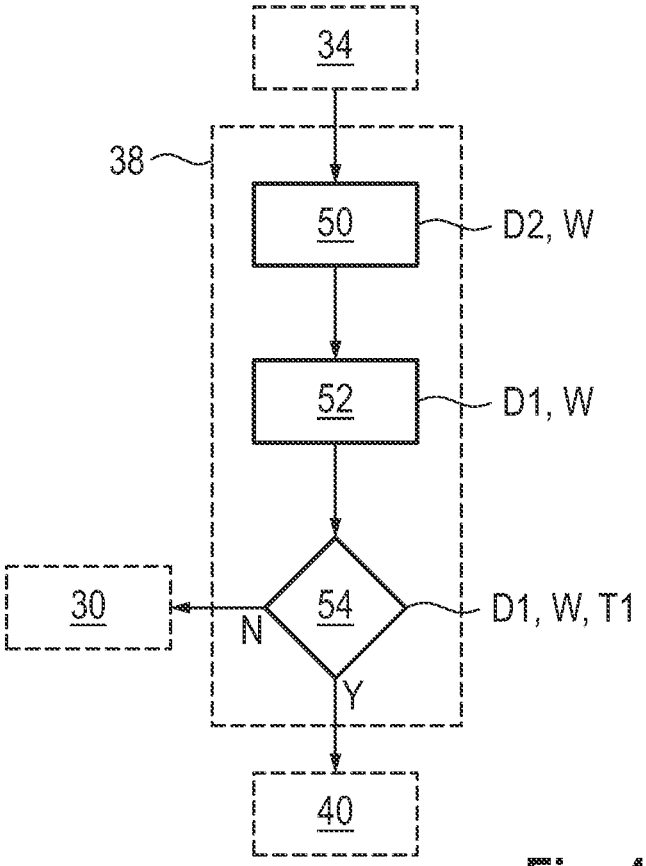
FIG. 4 is a flow chart of a second embodiment of the method step for recognizing speech accents.

FIGS. 3 and 4 show in more detail two alternative embodiments of the accent recognition step 38 of the method of FIG. 2. For both embodiments, the before-mentioned criterion for recognizing speech accents involves a comparison of the first derivative D1 of the time-averaged pitch P with a (first) threshold T1 which comparison is further influenced by the second derivative D2.

In the first embodiment, according to FIG. 3, the threshold T1 is offset (varied) in dependence of the second derivative D2. To this end, in a step 42, the speech enhancement unit 26 compares the second derivative D2 with a (second) threshold T2. If the second derivative D2 exceeds the threshold T2 (Y), the speech enhancement unit 26 sets the threshold T1 to a lower one of two pre-defined values (step 44). Otherwise (N), i.e. if the second derivative D2 does not exceed the threshold T2, the speech enhancement unit 26 sets the threshold T1 to the higher one of said two pre-defined values (step 46).

In a subsequent step 48, the speech enhancement unit 26 checks whether the first derivative D1 exceeds the threshold T1 (D1>T1?). If so (Y), the speech enhancement unit 26 proceeds to step 40, as previously described with respect to FIG. 2. Otherwise (N), as also described with respect to FIG. 2, the speech enhancement unit 26 triggers the voice recognition unit 14 to execute step 30 again.

In the second embodiment, according to FIG. 4, the first derivative D1 is weighted with a variable weight factor W which is determined in dependence of the second derivative D2. To this end, in a step 50, the speech enhancement unit 26 determines the weight factor W as a function of the second derivative D2. For example, W is set to a positive value W0 (W=W0 with W0>1) if D2 exceeds the threshold T2 whereas, otherwise, W is to 1 (W=1).

In a step 52, the speech enhancement unit 26 multiplies the first derivative D1 with the weight factor W (D1→W·D1).

Subsequently, in a step 54, the speech enhancement unit 26 checks whether the weighted first derivative D1, i.e. the product W·D1, exceeds the threshold T1 (W·D1>T1?). If so (Y), the speech enhancement unit 26 proceeds to step 40, as previously described with respect to FIG. 2. Otherwise (N), as also described with respect to FIG. 2, the speech enhancement unit 26 triggers the voice recognition unit 14 to execute step 30 again.

Figure 5:
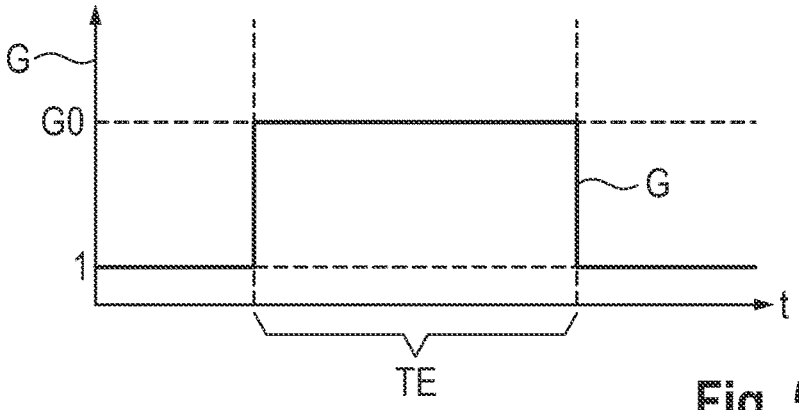
FIGS. 5 to 7 are graphs showing an amplitude of the processed sound signal over time in three different variants of temporarily increasing the amplitude of the processed sound signal.
Figure 6:
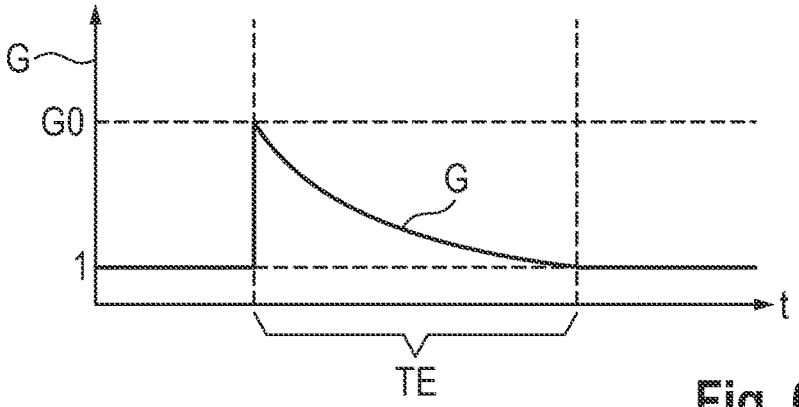
Figure 7:
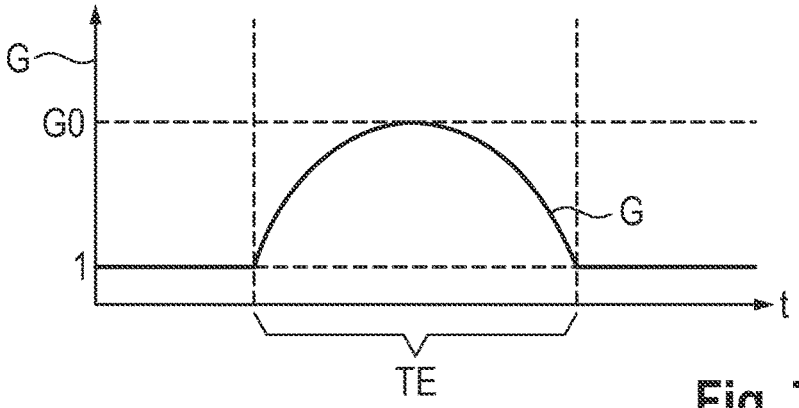

FIGS. 5 to 7 show three diagrams of the gain G over time t. Each diagram shows a different example of how to temporarily apply the gain G in step 40 and, thus, to increase the amplitude of the output audio signal O for the enhancement interval TE.

In a first example according to FIG. 5, the speech enhancement unit 26 increases the gain G step-wise (i.e. as a binary function of time t). If, in step 38, a speech accent is recognized, the gain G is set to a positive value G0 exceeding 1 (G=G0 with G0>1). This value G0 is maintained for the whole enhancement interval TE. After expiration of the enhancement interval TE, the gain G is reset to a constant value of 1 (G=1). The value G0 may be predefined as a constant. Alternatively, the value G0 may be varied in dependence of the first derivative D1 or the second derivative D2. For example, the value G0 may be proportional to the first derivative D1 (and, thus, increase/decrease with increasing/decreasing value of the derivative D1).

In a second example according to FIG. 6, if a speech accent is recognized, the gain G is step-wise (abruptly) set to the positive value G0. Thereafter, it is continuously decreased (having a linear or non-linear dependence of time) to reach G=1 at the end of the enhancement interval TE.

In a third example according to FIG. 7, if a speech accent is recognized, the gain G is continuously increased and, thereafter, continuously decreased to reach G=1 at the end of the enhancement interval TE.

Figure 8:
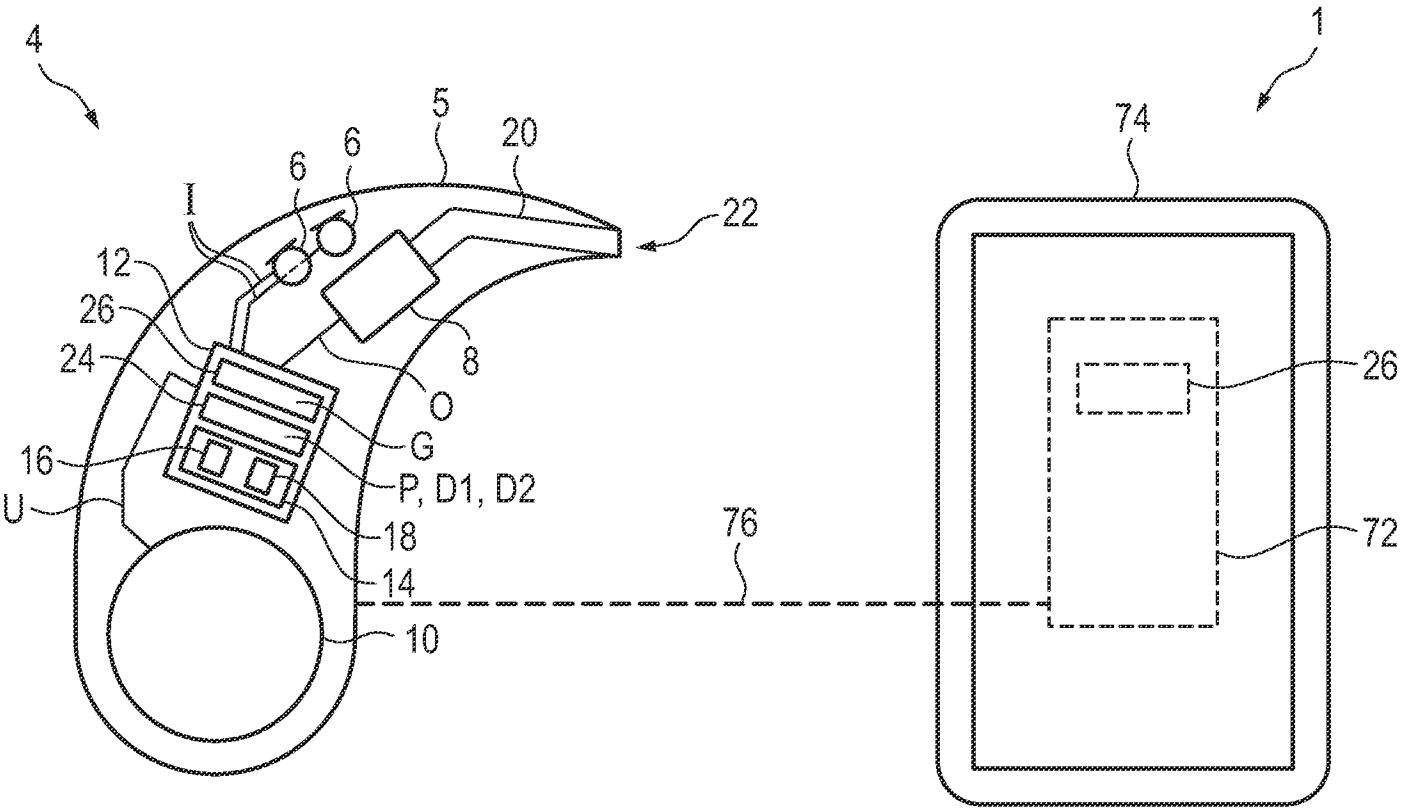
FIG. 8 is a schematic representation of a hearing system containing a hearing aid according to FIG. 1 and a software application for controlling and programming the hearing aid, the software application being installed on a mobile phone.

FIG. 8 shows a further embodiment of the hearing system 2 in which the latter comprises the hearing aid 4 as described before and a software application (subsequently denoted "hearing app" 72), that is installed on a mobile phone 74 of the user. Here, the mobile phone 74 is not a part of the system 2. Instead, it is only used by the system 74 as a resource providing computing power and memory.

The hearing aid 4 and the hearing application 72 exchange data via a wireless link 76, e.g. based on the Bluetooth standard. To this end, the hearing application 72 accesses a wireless transceiver (not shown) of the mobile phone 74, in particular a Bluetooth transceiver, to send data to the hearing aid 4 and to receive data from the hearing aid 4.

In the embodiment according to FIG. 10, some of the elements or functionality of the before-mentioned hearing system 2 are implemented in the hearing application 72. E.g., a functional part of the speech enhancement unit 26 being configured to perform the step 38 is implemented in the hearing application 72.

It will be appreciated by persons skilled in the art that numerous variations and/or modifications may be made to the invention as shown in the specific examples without departing from the spirit and scope of the invention as broadly described in the claims. The present examples are, therefore, to be considered in all aspects as illustrative and not restrictive.

LIST OF REFERENCES

2 (hearing) system
4 hearing aid
5 housing
6 microphones
8 receiver
10 battery
12 signal processor
14 voice recognition unit
16 voice detection module (VD module)
18 own voice detection module (OVD module)
20 sound channel
22 tip
24 derivation unit
26 speech enhancement unit
30 step
32 step
34 step
36 step

38 step
40 step
42 step
44 step
46 step
48 step
50 step
52 step
54 step
72 hearing app
74 mobile phone
76 wireless link
t time
D1 first derivative
D2 second derivative
G gain
G0 value
I input audio signal
O output audio signal
P pitch
T1 threshold
T2 threshold
TE enhancement interval
U supply voltage
W weight factor
W0 value

The invention claimed is:

1. A method for operating a hearing instrument configured to support hearing of a hearing-impaired user, which comprises the steps of:

capturing a sound signal from an environment of the hearing instrument;

processing a captured sound signal to at least partially compensate a hearing-impairment of the hearing-impaired user;

analyzing the captured sound signal to recognize speech intervals, in which the captured sound signal contains speech;

determining, during recognized speech intervals, at least one time derivative of an amplitude and/or a pitch of the captured sound signal;

temporarily increasing the amplitude of a processed sound signal, if the at least one derivative fulfills a predefined criterion; and outputting the processed sound signal to the hearing-impaired user.

2. The method according to claim 1, which further comprises increasing the amplitude of the processed sound signal for a predefined time interval, if the at least one derivative fulfills the predefined criterion.

3. The method according to claim 2, wherein within the predefined time interval, the amplitude of the processed sound signal is continuously increased and/or continuously decreased.

4. The method according to claim 1, wherein according to the predefined criterion, the amplitude of the processed sound signal is temporarily increased if the at least one derivative exceeds a predefined threshold or is within a predefined range.

5. The method according to claim 1, wherein the at least one derivative is a time-averaged derivative of the amplitude and/or the pitch of the captured sound signal.

6. The method according to claim 1, wherein the at least one derivative has a first derivative.

7. The method according to claim 6, wherein the at least one derivative further has at least one higher order derivative.

8. The method according to claim 7, wherein:

according to the predefined criterion, the amplitude of the processed sound signal is temporarily increased if the at least one first derivative exceeds a predefined threshold or is within a predefined range; and the predefined threshold or the predefined range is varied in dependence of the higher order derivative.

9. The method according to claim 1, wherein the amplitude of the processed sound signal is temporarily increased by an amount that is varied in dependence of the at least one derivative.

10. The method according to claim 1, wherein:

recognized speech intervals are differentiated into own-voice intervals, in which the hearing-impaired user speaks, and foreign-voice intervals, in which at least one different speaker speaks; and the step of temporarily increasing the amplitude of the processed sound signal is only performed during the foreign-voice intervals.

11. A hearing instrument of a hearing system configured to support a hearing of a hearing-impaired user, the hearing instrument comprising:

an input transducer disposed to capture a sound signal from an environment of the hearing instrument;

a signal processor disposed to process a captured sound signal to at least partially compensate a hearing-impairment of the hearing-impaired user;

an output transducer disposed to emit a processed sound signal to the user;

a voice recognition unit configured to analyze the captured sound signal to recognize speech intervals, in which the captured sound signal contains speech;

a derivation unit configured to determine, during recognized speech intervals, at least one time derivative of an amplitude and/or a pitch of the captured sound signal; and a speech enhancement unit configured to temporarily increase the amplitude of the processed sound signal, if the at least one derivative fulfills a predefined criterion to enhance speech accents.

12. The hearing system according to claim 11, wherein said speech enhancement unit is configured to increase the amplitude of the processed sound signal for a predefined time interval if the at least one derivative fulfills the predefined criterion.

13. The hearing system according to claim 12, wherein said speech enhancement unit is configured to continuously increase and/or continuously decrease the amplitude of the processed sound signal within the predefined time interval.

14. The hearing system according to claim 11, wherein said speech enhancement unit is configured to temporarily increase the amplitude of the processed sound signal, according to the predefined criterion, if the at least one derivative exceeds a predefined threshold or is within a predefined range.

15. The hearing system according to claim 11, wherein the at least one derivative is a time-averaged derivative of the amplitude and/or the pitch.

16. The hearing system according to claim 11, wherein the at least one derivative contains a first derivative.

17. The hearing system according to claim 16, wherein the at least one derivative has at least one higher order derivative.

18. The hearing system according to claim 17, wherein said speech enhancement unit is configured to:

temporarily increase the amplitude of the processed sound signal, according to the predefined criterion, if the first derivative exceeds a predefined threshold or is within a predefined range; and vary the predefined threshold or the predefined range in dependence on the higher order derivative.

19. The hearing system according to claim 11, wherein said speech enhancement unit is configured to temporarily increase the amplitude of the processed sound signal by an amount that is varied in dependence on the at least one derivative.

20. The hearing system according to claim 11, wherein:

said voice recognition unit is configured to differentiate recognized speech intervals into own-voice intervals, in which the hearing-impaired user speaks, and foreign-voice intervals, in which at least one different speaker speaks; and said speech enhancement unit temporarily increases the amplitude of the processed sound signal during the foreign-voice intervals only.

* * * * *